US008887594B2

(12) United States Patent
Ruth

(10) Patent No.: US 8,887,594 B2
(45) Date of Patent: Nov. 18, 2014

(54) ASSEMBLY FOR SELECTIVELY LOCKING THE ANGULAR POSITION OF A BIASED THROTTLE GRIP

(71) Applicant: Stephen M. Ruth, Holly, MI (US)

(72) Inventor: Stephen M. Ruth, Holly, MI (US)

(73) Assignee: AKS Engineering, LLC, Holly, MI (US)

( * ) Notice: Subject to any disclaimer, the term of this patent is extended or adjusted under 35 U.S.C. 154(b) by 95 days.

(21) Appl. No.: 13/765,789

(22) Filed: Feb. 13, 2013

(65) Prior Publication Data

US 2013/0213177 A1 Aug. 22, 2013

Related U.S. Application Data

(60) Provisional application No. 61/600,112, filed on Feb. 17, 2012.

(51) Int. Cl.
*G05G 11/00* (2006.01)

(52) U.S. Cl.
USPC ..... 74/488

(58) Field of Classification Search
USPC ..... 74/488, 489, 504, 551.9
See application file for complete search history.

(56) References Cited

U.S. PATENT DOCUMENTS

| | | | | |
|---|---|---|---|---|
| 3,752,006 | A * | 8/1973 | Bartlett | 74/489 |
| 3,782,219 | A * | 1/1974 | Beck et al. | 74/531 |
| 3,982,446 | A | 9/1976 | Van Dyken | |
| 4,060,008 | A | 11/1977 | Wilkinson | |
| 4,137,793 | A | 2/1979 | Sowell | |
| 4,256,197 | A | 3/1981 | Kiser, Jr. | |
| 4,364,283 | A | 12/1982 | Ricardo | |
| 4,610,230 | A | 9/1986 | Saito et al. | |
| 5,893,295 | A | 4/1999 | Bronnert | |
| 6,250,173 | B1 | 6/2001 | Huston | |
| 6,491,555 | B2 | 12/2002 | Kitsu et al. | |
| 6,820,710 | B2 | 11/2004 | Fechner | |
| 7,445,071 | B2 | 11/2008 | Yamazaki et al. | |
| 8,272,294 | B2 | 9/2012 | Ashman | |
| 8,336,423 | B2 * | 12/2012 | Suzuki | 74/504 |

* cited by examiner

*Primary Examiner* — Vicky A. Johnson
(74) *Attorney, Agent, or Firm* — Brooks Kushman P.C.

(57) ABSTRACT

An assembly for selectively locking the angular position of a biased throttle grip mounted on an end of a handlebar to control engine speed is provided. The assembly includes a first member having a first face and adapted to be mounted on the end of the handlebar and a second member having a second face in close-spaced opposition to the first face and a third face spaced from the second face and in close-spaced opposition to an end face of the throttle grip when the first member is mounted on the end of the handlebar. The second member is mounted for rotation about an axis and for controlled shifting movement along the axis relative to the first member between a first position which corresponds to the unlocked mode of the assembly and a second position which corresponds to a locked mode of the assembly.

20 Claims, 2 Drawing Sheets

ASSEMBLY FOR SELECTIVELY LOCKING THE ANGULAR POSITION OF A BIASED THROTTLE GRIP

CROSS-REFERENCE TO RELATED APPLICATIONS

This application claims the benefit of U.S. provisional patent application entitled "Motorcycle Throttle Lock or Control Device" filed Feb. 17, 2012 and having Application No. 61/600,112.

TECHNICAL FIELD

This invention generally relates to cruise control assemblies for vehicles such as motorcycles, and, specifically, to return-biased throttle lock assemblies or control assemblies for such vehicles.

OVERVIEW

In numerous vehicles of the type having handlebars, as opposed to a wheel for steering, the throttle is located at the end of the handlebars and is arranged to be operated by rotation of the grip at the end of the handlebar. As in most motorized vehicles, the throttle is equipped with a spring return so that when the throttle is released, the engine automatically returns to idle speed.

Riders of motorcycles often get wrist fatigue from having to hold the throttle "on" in one position for long periods of time, such as extended distances on interstate highways. Throttle locks are used to keep motorcycles at a relatively constant speed while allowing the motorcycle riders to temporarily remove their hands from the throttle to rest.

U.S. Pat. No. 5,893,295 (i.e., the '295 patent) discloses a throttle locking device mounted in a position to engage a hand grip on one end of the handlebar. The device includes a tubular housing mounted on one end of the handlebar, a bearing sleeve rotatably mounted on the tubular housing and a cap rotatably mounted on the bearing sleeve. The device further includes a ramp plate mounted on the housing, a number of rods connecting the ramp plate to the housing, and a number of balls mounted on the inside of the cap in alignment with the ramp plate whereby the bearing sleeve is moved into engagement with the hand grip on rotation of the cap.

Although the '295 patent provides the function of locking the throttle in place by rotating the outer sleeve to apply an axial load, it is complex, uses many parts and does not have one-way "on", and two-way "off" features for safety.

Other U.S. patents related to the present invention include: U.S. Pat. Nos. 3,982,446; 4,060,008; 4,137,793; 4,256,197; 4,364,283; 4,610,230; 6,250,173; 6,491,555; 6,820,710; 7,445,071; and 8,272,294.

SUMMARY OF EXAMPLE EMBODIMENTS

An object of at least one embodiment of the present invention is to provide an assembly for selectively locking the angular position of a biased throttle grip mounted on an end of a handlebar to control engine speed wherein the assembly is relatively simple, has a relatively small number of parts and has at least one safety feature.

In carrying out the above object and other objects of at least one embodiment of the present invention, an assembly for selectively locking the angular position of a biased throttle grip mounted on an end of a handlebar to control engine speed is provided. The assembly includes a first member having a first face and adapted to be mounted on the end of the handlebar and a second member having a second face in close-spaced opposition to the first face and a third face spaced from the second face and in close-spaced opposition to an end face of the throttle grip when the first member is mounted on the end of the handlebar. The second member is mounted for rotation about an axis and for controlled shifting movement along the axis relative to the first member between a first position which corresponds to the unlocked mode of the assembly and a second position which corresponds to a locked mode of the assembly. One of the first and second faces defines a reference surface and at least one depression of a first predetermined depth. Each depression has bottom and side surfaces. One of the side surfaces is a ramped cam surface adjacent the bottom surface and tangentially intersecting the reference surface. The assembly also includes at least one cam follower mechanism. Each mechanism includes a follower disposed between the first and second faces and riding on its ramped cam surface to move the second member from the first position to the second position during rotation of the second member in a first direction about the axis and cause the third face of the second member to compress against the end face of the throttle grip to lock the second member and the throttle grip together to prevent slippage between the third and end faces.

The one of the first and second faces may have at least one second depression. Each second depression has a second predetermined depth less than the first predetermined depth for seating its respective follower in the locked mode of the assembly.

Each mechanism may include a biasing member for exerting a biasing force on its respective follower, each follower exerting a biasing force on the second member during the riding on the ramped cam surface.

The reference surface may be generally normal to the axis.

The first, second and third faces may be generally annular and extend generally radially with respect to the axis.

Each follower may be movable out of its respective second depression upon rotation of the second member in either direction about the axis. The first member may include a cylindrical portion wherein the second member is rotatably and slidably mounted on the cylindrical portion. The assembly may further include a retaining ring for retaining the second member on the cylindrical portion of the first member.

The engine may be a vehicle engine and the vehicle may be a motorcycle.

The first member may be a bar end member.

The bar end member may have an axial bore wherein the assembly includes a fastener which extends through the bore to mount the bar end member on the end of the handlebar.

The second member may be a cam plate.

The other one of the first and second faces may include at least one axial bore wherein each mechanism includes an outer body secured within its axial bore.

One of the side surfaces opposite the ramped cam surface may be substantially perpendicular to the bottom surface to prevent rotation of the second member in a second direction opposite the first direction about the axis when the follower is disposed in its respective depression in the unlocked mode of the assembly.

Each biasing member may include a spring. Each spring may be substantially uncompressed in the unlocked mode of the assembly so that its corresponding follower does not exert an axial biasing force on the second member in the unlocked mode.

Further in carrying out the above object and other objects of at least one embodiment of the present invention, an assembly for selectively locking the angular position of a biased throttle grip mounted on an end of a handlebar to control engine speed is provided. The assembly includes a first member having a first face and adapted to be mounted on the end of the handlebar and a second member having a second face in close-spaced opposition to the first face and a third face spaced from the second face and in close-spaced opposition to an end face of the throttle grip when the first member is mounted on the end of the handlebar. The second member is mounted for rotation about an axis and for controlled shifting movement along the axis relative to the first member between a first position which corresponds to the unlocked mode of the assembly and a second position which corresponds to a locked mode of the assembly. One of the first and second faces defines a reference surface and a plurality of depressions of a first predetermined depth. Each depression has bottom and side surfaces. One of the side surfaces is a ramped cam surface adjacent the bottom surface and tangentially intersecting the reference surface. The assembly further includes a plurality of cam follower mechanisms. Each mechanism includes a follower disposed between the first and second faces and riding on its respective ramped cam surface to move the second member from the first position to the second position during rotation of the second member in a first direction about the axis and cause the third face of the second member to compress against the end face of the throttle grip to lock the second member and the throttle grip together to prevent slippage between the third and end faces.

The one of the first and second faces may have a plurality of second depressions. Each second depression may have a second predetermined depth less than the first predetermined depth for seating its respective follower in the locked mode of the assembly.

Still further in carrying out the above object and other objects of at least one embodiment of the present invention, an assembly for selectively locking the angular position of a biased throttle grip mounted on an end of a motorcycle handlebar to control engine speed is provided. The assembly includes a bar end having a first face and adapted to be mounted on the end of the handlebar and a cam plate having a second face in close-spaced opposition to the first face and a third face spaced from the second face and in close-spaced opposition to an end face of the throttle grip when the bar end is mounted on the end of the handlebar. The cam plate is mounted for rotation about an axis and for controlled shifting movement along the axis relative to the bar end between a first position which corresponds to the unlocked mode of the assembly and a second position which corresponds to a locked mode of the assembly. The second face defines a reference surface and a plurality of depressions of a first predetermined depth. Each depression has bottom and side surfaces. One of the side surfaces is a ramped cam surface adjacent the bottom surface and tangentially intersecting the reference surface. The assembly also includes a plurality of spring plunger subassemblies. Each subassembly includes a plunger and a spring for biasing its plunger between the first and second faces. Each plunger rides on its respective cam surface to compress its spring and exert an axial biasing force on the cam plate to move the cam plate from the first position to the second position during rotation of the cam plate in a first direction about the axis and cause the third face of the cam plate to compress against the end face of the throttle grip to lock the cam plate and the throttle grip together to prevent slippage between the third and end faces.

The second face may have a plurality of second depressions. Each second depression may have a second predetermined depth less than the first predetermined depth for seating its respective plunger in the locked mode of the assembly.

DETAILED DESCRIPTION OF EXAMPLE EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In one example embodiment, a motorcycle throttle lock or control assembly in which one member or component (commonly referred to as a bar end) mounts into a fixed position in the handlebar tube adjacent to the throttle grip. Another member or component (cam plate) is located between the bar end and the throttle grip. The stationary bar end contains one or more cam follower mechanisms in the form of spring plunger subassemblies that push the engagement cam plate into the end of the throttle grip and by friction keeps the throttle grip in that position. The friction force can easily be overpowered by hand. The cam plate surface or face contains two sets of depressions (shallow and deep) that align with their respective spring plunger subassemblies. As the plate is rotated, the spring plunger subassemblies compress due to the change in depth of the depressions, thus creating enough axial force on the end of the throttle to keep it in the same position when the operator's hand is released.

Figure 1:
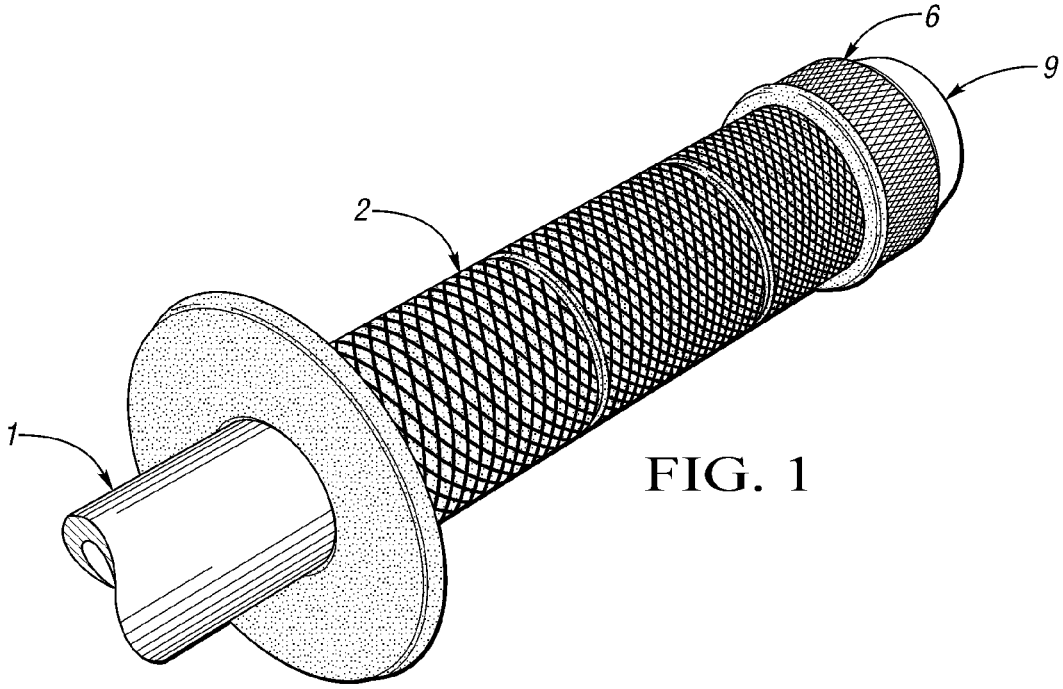
FIG. 1 is a perspective, environmental view, partially broken away, of a motorcycle throttle control assembly or lock device assembly constructed in accordance with one embodiment of the invention and mounted at one end of a handle bar.
Figure 2A:
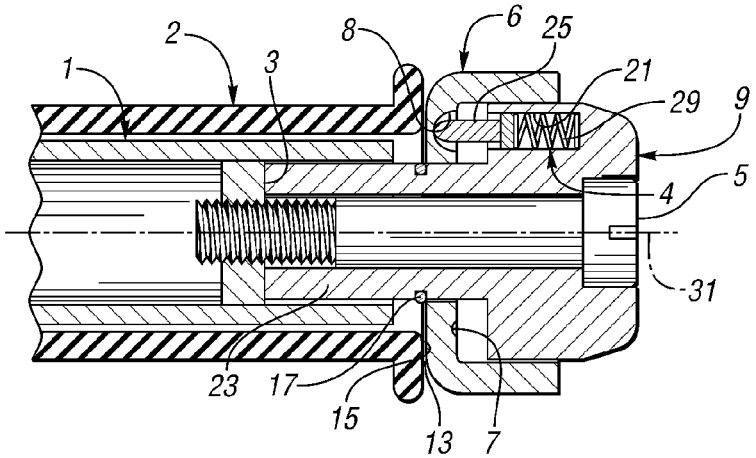
FIG. 2*a* is a view, partially broken away and in cross section, of the assembly of FIG. 1 in its unlocked mode.
Figure 2B:
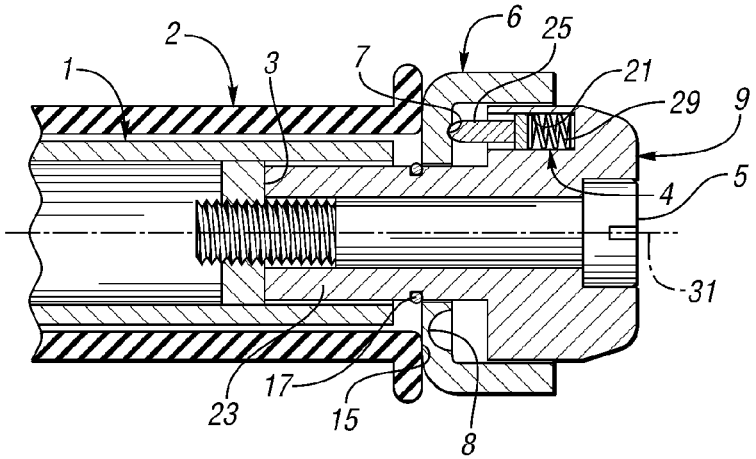
FIG. 2*b* is a view, similar to the view of FIG. 2*a*, but with the assembly in its locked mode.
Figure 3:
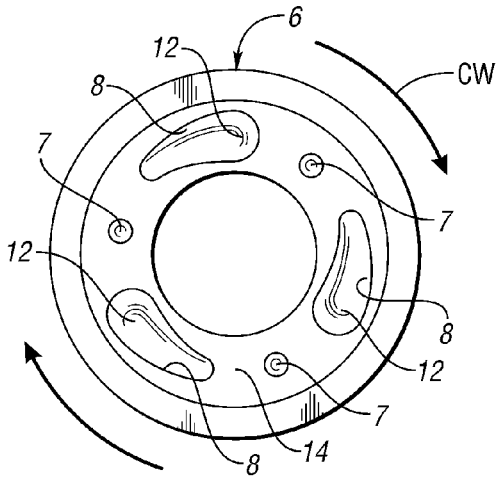
FIG. 3 is an end view of a cam plate of the assembly.

Referring now to the drawing figures, common to most all motorcycles, a rubber throttle grip, generally indicated at 2, of FIG. 1 is axially fixed in place over a handle bar tube, generally indicated at 1, of a motorcycle. The throttle grip 2 can be rotated by hand in a counter clockwise, CCW, direction (opposite the direction of FIG. 3) in order to speed up the engine but also has a return spring built-in to bring the throttle grip 2 back to the idle position when the hand of the driver is removed. A bar end part, generally indicated at 9, common to many motorcycles is bolted in place via a bolt 5, inside the handle bar tube 1, via a nut 3 (FIGS. 2*a* and 2*b*) typically welded in place. The bar end part 9 provides two functions: (1) an anti-vibration weight, and (2) protection of the throttle grip 2 if the bike or motorcycle is dropped.

In one aspect of this invention, the bar end part 9 is modified by drilling and tapping one or more holes 21 therein and inserting a commercially available standard spring plunger subassembly, generally indicated at 4 in the hole(s) 21. A cam plate, generally indicated at 6, is located between the fixed bar end part 9 and the throttle grip 2. The cam plate 6 preferably contains at least 2 pairs of dimples 7 and 8 (depressions) that align themselves concentrically on the same diameter as spring-biased plungers 25 of the assemblies 4. One of the dimples 7 has less depth than another one of the dimples 8. The cam plate 6 is retained on a cylindrical portion 23 of the end part 9 by a retainer ring 17 contained within a groove 27 to hold the assembly together.

Figure 4:
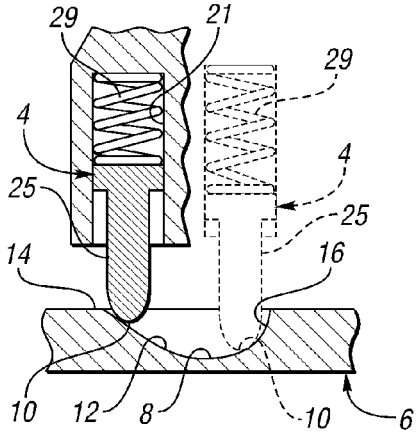
FIG. 4 is a side view, partially broken away and in cross section, of the cam plate and spring plunger subassembly in a retracted position (via solid lines) and an extended position (via phantom lines)

When the throttle lock drive assembly is "off" there is a small gap 13 between the cam plate 6 and the handle grip 2, and the throttle grip 2 is free to turn. A spring plunger tip part 10 of the assembly 4 is adjusted so as to match the depth of the dimple 8 and therefore no axial spring force is applied to the cam plate 6. As the cam plate 6 is rotated in the CW direction (FIG. 3) about an axis 31 (FIGS. 2*a* and 2*b*), the spring plunger tip part 10 compresses its spring 29 as it climbs up a ramp 12 (FIG. 4). The length of the spring compression exceeds the gap 13 length and applies a sufficient axial force on the throttle end face 15 to counteract the return spring force of the throttle. Rotating the cam plate 6 further, the spring plunger tip part 10 will seat itself in the dimple 7 to provide a positive location or lock for the assembly when it is in its "on" position.

The cam plate ramp 12 begins at the depth of the dimple 8 and then smoothly transitions up to an inner reference surface 14 of the plate 6. The ramp 12 allows the spring plunger tip part 10 to compress its spring 29 as the cam plate 6 is rotated in the clockwise, CW, direction. The cam plate 6 cannot be rotated in the CCW direction because a vertical wall 16 of the dimple 8 is too steep to allow the plunger tip part 10 to compress its spring 29 as shown in FIG. 4.

All motorcycle throttles only rotate in the CCW direction in order to speed up the engine. Since the cam plate 6 can only be rotated in the CW direction it will not allow any inadvertent acceleration of the motorcycle when turning the assembly "on". The depth of each dimple 7 is designed to be shallow enough to allow the assembly to be turned "off" by rotating in either direction.

Figure 5:
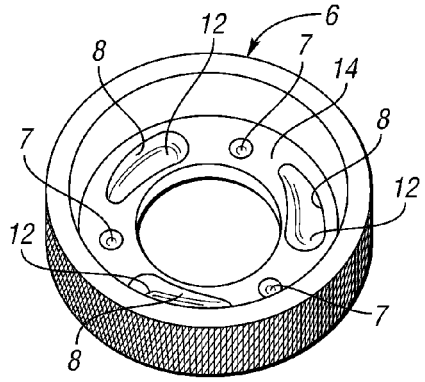
FIG. 5 is a perspective view of the cam plate and a modified bar end part of the assembly.
Figure 5:
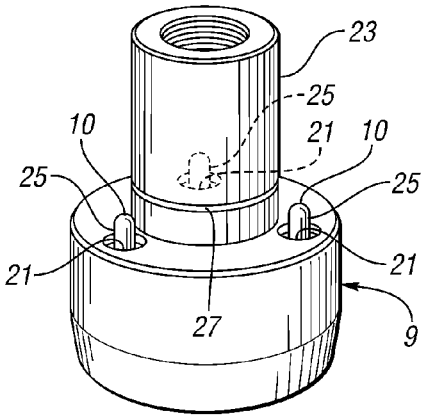
Figure 6:
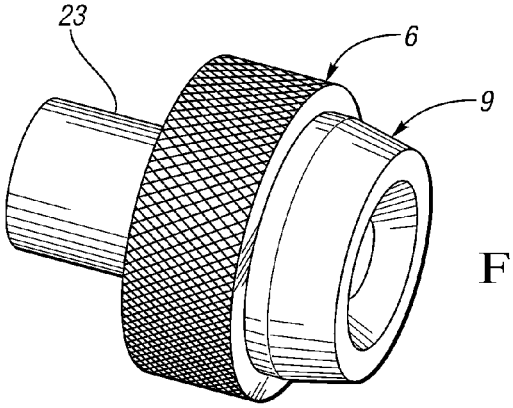
FIG. 6 is a perspective view of the cam plate and the end part assembled together.

In one example embodiment of the invention as shown in FIGS. 4 and 5, the assembly is preferably made up of only 3 components, the bar end 9, the cam plate 6 and one or more spring plunger assemblies 4. Common spring plunger assemblies, such as the assemblies 4, are available in various sizes, shapes and spring loads and typically have a threaded outer body or housing so they can be screwed into a tapped hole such as the tapped holes 21 in the bar end 9.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An assembly for selectively locking the angular position of a biased throttle grip mounted on an end of a handlebar to control engine speed, the assembly comprising:

a first member having a first face and adapted to be mounted on the end of the handlebar;

a second member having a second face in close-spaced opposition to the first face and a third face spaced from the second face and in close-spaced opposition to an end face of the throttle grip when the first member is mounted on the end of the handlebar, the second member being mounted for rotation about an axis and for controlled shifting movement along the axis relative to the first member between a first position which corresponds to the unlocked mode of the assembly and a second position which corresponds to a locked mode of the assembly, wherein one of the first and second faces defines a reference surface and at least one depression of a first predetermined depth, each depression having bottom and side surfaces, one of the side surfaces being a ramped cam surface adjacent the bottom surface and tangentially intersecting the reference surface; and at least one cam follower mechanism including a follower disposed between the first and second faces and riding on its ramped cam surface to move the second member from the first position to the second position during rotation of the second member in a first direction about the axis and cause the third face of the second member to compress against the end face of the throttle grip to lock the second member and the throttle grip together to prevent slippage between the third and end faces.

2. The assembly as claimed in claim 1, wherein the one of the first and second faces has at least one second depression, each second depression having a second predetermined depth less than the first predetermined depth for seating its respective follower in the locked mode of the assembly.

3. The assembly as claimed in claim 2, wherein each follower is movable out of its respective second depression upon rotation of the second member in either direction about the axis.

4. The assembly as claimed in claim 1, wherein each mechanism includes a biasing member for exerting a biasing force on its respective follower, each follower exerting a biasing force on the second member during the riding on the ramped cam surface.

5. The assembly as claimed in claim 4, wherein each biasing member comprises a spring, each spring being substantially uncompressed in the unlocked mode of the assembly so that its corresponding follower does not exert an axial biasing force on the second member in the unlocked mode.

6. The assembly as claimed in claim 1, wherein the reference surface is generally normal to the axis.

7. The assembly as claimed in claim 1, wherein the first, second and third faces are generally annular and extend generally radially with respect to the axis.

8. The assembly as claimed in claim 1, wherein the first member includes a cylindrical portion and wherein the second member is rotatably and slidably mounted on the cylindrical portion.

9. The assembly as claimed in claim 8, further comprising a retaining ring for retaining the second member on the cylindrical portion of the first member.

10. The assembly as claimed in claim 1, wherein the engine is a vehicle engine.

11. The assembly as claimed in claim 10, wherein the vehicle is a motorcycle.

12. The assembly as claimed in claim 1, wherein the first member comprises a bar end member.

13. The assembly as claimed in claim 12, wherein the bar end member has an axial bore and wherein the assembly includes a fastener which extends through the bore to mount the bar end member on the end of the handlebar.

14. The assembly as claimed in claim 1, wherein the second member comprises a cam plate.

15. The assembly as claimed in claim 1, wherein the other one of the first and second faces includes at least one axial bore and wherein each mechanism includes an outer body secured within its axial bore.

16. The assembly as claimed in claim 1, wherein one of the side surfaces opposite the ramped cam surface is substantially perpendicular to the bottom surface to prevent rotation of the second member in a second direction opposite the first direction about the axis when the follower is disposed in its respective depression in the unlocked mode of the assembly.

17. An assembly for selectively locking the angular position of a biased throttle grip mounted on an end of a handlebar to control engine speed, the assembly comprising:

a first member having a first face and adapted to be mounted on the end of the handlebar;

a second member having a second face in close-spaced opposition to the first face and a third face spaced from the second face and in close-spaced opposition to an end face of the throttle grip when the first member is mounted on the end of the handlebar, the second member being mounted for rotation about an axis and for controlled shifting movement along the axis relative to the first member between a first position which corresponds to the unlocked mode of the assembly and a second position which corresponds to a locked mode of the assembly, wherein one of the first and second faces defines a reference surface and a plurality of depressions of a first predetermined depth, each depression having bottom and side surfaces, one of the side surfaces being a ramped cam surface adjacent the bottom surface and tangentially intersecting the reference surface; and a plurality of cam follower mechanisms, each mechanism including a follower disposed between the first and second faces and riding on its respective ramped cam surface to move the second member from the first position to the second position during rotation of the second member in a first direction about the axis and cause the third face of the second member to compress against the end face of the throttle grip to lock the second member and the throttle grip together to prevent slippage between the third and end faces.

18. The assembly as claimed in claim 17, wherein the one of the first and second faces has a plurality of second depressions, each second depression having a second predetermined depth less than the first predetermined depth for seating its respective follower in the locked mode of the assembly.

19. An assembly for selectively locking the angular position of a biased throttle grip mounted on an end of a motorcycle handlebar to control engine speed, the assembly comprising:

a bar end having a first face and adapted to be mounted on the end of the handlebar;

a cam plate having a second face in close-spaced opposition to the first face and a third face spaced from the second face and in close-spaced opposition to an end face of the throttle grip when the bar end is mounted on the end of the handlebar, the cam plate being mounted for rotation about an axis and for controlled shifting movement along the axis relative to the bar end between a first position which corresponds to the unlocked mode of the assembly and a second position which corresponds to a locked mode of the assembly, wherein the second face defines a reference surface and a plurality of depressions of a first predetermined depth, each depression having bottom and side surfaces, one of the side surfaces being a ramped cam surface adjacent the bottom surface and tangentially intersecting the reference surface; and a plurality of spring plunger subassemblies, each subassembly including a plunger and a spring for biasing its plunger between the first and second faces, each plunger riding on its respective cam surface to compress its spring and exert an axial biasing force on the cam plate to move the cam plate from the first position to the second position during rotation of the cam plate in a first direction about the axis and cause the third face of the cam plate to compress against the end face of the throttle grip to lock the cam plate and the throttle grip together to prevent slippage between the third and end faces.

20. The assembly as claimed in claim 19, wherein the second face has a plurality of second depressions, each second depression having a second predetermined depth less than the first predetermined depth for seating its respective plunger in the locked mode of the assembly.

* * * * *